United States Patent [19]

Rutshtein et al.

[11] 4,102,604

[45] Jul. 25, 1978

[54] METHOD AND APPARATUS FOR NONINTERACTING CONTROL OF A DYNAMIC COMPRESSOR HAVING ROTATING VANES

[75] Inventors: Alexander Rutshtein; Naum Staroselsky, both of West Des Moines, Iowa

[73] Assignee: Compressor Controls Corporation, Des Moines, Iowa

[21] Appl. No.: 793,761

[22] Filed: May 4, 1977

[51] Int. Cl.[2] ..... F04B 49/00

[52] U.S. Cl. ..... 417/19; 417/20; 417/22; 417/23; 417/26; 417/32; 417/47

[58] Field of Search ..... 417/18–24, 417/26–32, 47, 53

[56] References Cited

U.S. PATENT DOCUMENTS

| | | | |
|---|---|---|---|
| 2,871,671 | 2/1959 | Bartloff, Jr. et al. | 417/21 |
| 3,068,796 | 12/1962 | Pfluger et al. | 417/26 |
| 3,994,623 | 11/1976 | Rutshtein et al. | 417/19 |

FOREIGN PATENT DOCUMENTS

| | | | |
|---|---|---|---|
| 871,083 | 6/1961 | United Kingdom | 417/47 |

*Primary Examiner*—William L. Freeh

*Attorney, Agent, or Firm*—Henderson, Strom, Sturm, Cepican & Fix

[57] ABSTRACT

A control system is disclosed for a noninteracting control and protection of a dynamic compressor having rotating vanes.

The method consists of a junction of a few control circuits for controlling the performance of a dynamic compressor, for protecting compressor from approaching dangerous zones of operation, and for maintaining a required mass flow rate of a gas through the compressor.

An automatic control system based on using the above method is distinguished by its simplicity, great transient and steady state precision and high reliability of surge protection.

2 Claims, 6 Drawing Figures

METHOD AND APPARATUS FOR NONINTERACTING CONTROL OF A DYNAMIC COMPRESSOR HAVING ROTATING VANES

BACKGROUND OF THE INVENTION

This invention relates to the means of controlling the flow rate through the dynamic compressor having rotating vanes.

Control systems of such compressors are designed for changing their performance to fit the requirements of the user's process.

On the other hand, in order to protect the compressor from approaching a zone of instable operation, a control system must provide for limiting a possible safe range of changing the above performance. The known conventional compressor control systems are supposed to solve the last named problem by using two or more independent control loops operating in parallel.

One of these (this loop henceforth will be called "process control loop") controls the process parameter, for instance, mass flow rate, by changing the performance of the installation. Another loop limits the range of changing the above performance in an indirect way, using blowing-off or recycling of a compressed gas in order to provide a required change of an equivalent resistance of a delivery network (the load characteristic).

If, for example, while maintaining constant mass flow rate, the load increases, then the discharge pressure can reach a permissible limit. At this moment the process control loop and the protective control loop begin to operate simultaneously. During this transient period, the process control loop continues to change the performance and this can interfere with protective systems designed to keep the compressor from approaching the surge zone, especially in cases when the protective control loop controlling a relief valve includes one or more elements having nonlinearities like hysteresis or dead zones.

This disadvantage may be eliminated by using a noninteracting control and protective system of a dynamic compressor with the rotating vanes.

According to "Process Measurement & Control Terminology," SAMA Standard, PMC 20–1970, page 11, a noninteracting control system is a "multi-element control system designed to avoid disturbances to other controlled variables due to the process input adjustment which are made for the purpose of controlling a particular process variable."

Introducing a compressor control system of the above mentioned type is the main goal of this invention.

SUMMARY OF THE INVENTION

This invention pursues two main aims: (1) providing the widest safe operating range physically available for any given compressor without blowing-off or recycling of a compressed gas; and (2) providing very reliable protection of the compressor unit from inadmissible operating conditions like surge or high speed of rotation by using a noninteracting principle of control and protection.

According to this invention, the dynamic compressor is controlled and protected by an integrated control system which provides the noninteracting operation of both its control and protective circuits.

The system of this invention consists of five control modules including a performance control module, a protective control module and a process control module. The first of them, the performance control module, provides for changing the performance of the compressor unit according to the control strategy developed by either a process control module or a protective control module.

The structure of the protective control module is a main distinctive feature of the present invention. This module selects a required strategy of changing a compressor's performance.

When an operating point of a compressor is far enough from the surge zone, then the compressor's performance is changed according to a strategy, or a law determined by the main process parameter, and the protective module does not influence the above named law.

But at the moment when the operating line of the compressor crosses the line limiting its safe operating zone, the protective module smoothly changes the strategy of controlling the performance. Beginning from this moment and during the whole transient period, the above strategy provides for shifting the operating point along the line limiting the safe operating zone rather than in direction of surge limit. At the same time the protective module begins to open the relief means connected to compressor's discharge port in order to compensate for the above mentioned operating point's shifting, so that at the end of the transient process, the operating point returns to the point of intersection of the process control line and the line limiting compressor's safe operating zone.

DETAILED DESCRIPTION OF THE INVENTION

Figure 1:
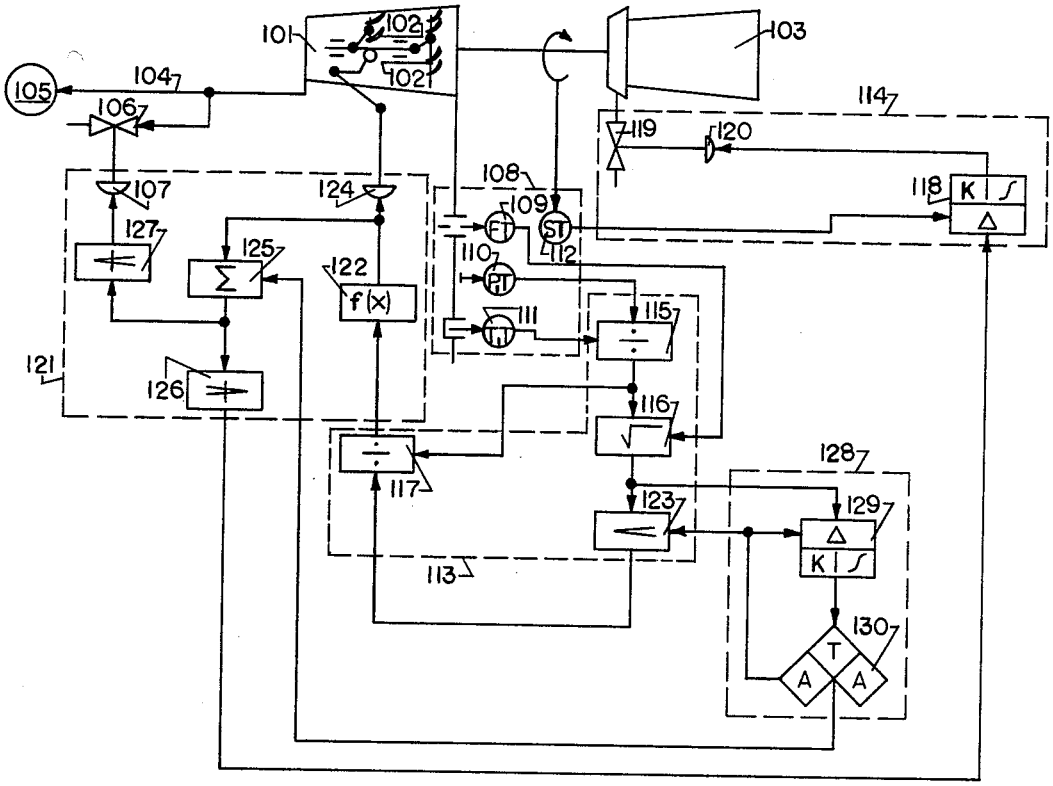
FIG. 1 is a schematic diagram of the flow control system.

Referring now to the drawings, FIG. 1 shows, for example, an air compressor installation with a flow control system of the present invention.

The installation includes an axial compressor 101 for compressing air with rotating stator vanes 102, a steam turbine drive 103, a pipeline 104 connecting the compressor 101 with a user 105 of the compressed air. The pipeline 104 is supplied by a blow-off valve 106 having the actuator 107.

The present invention utilizes the particularities of design of the compressors having rotating vanes.

Figure 2:
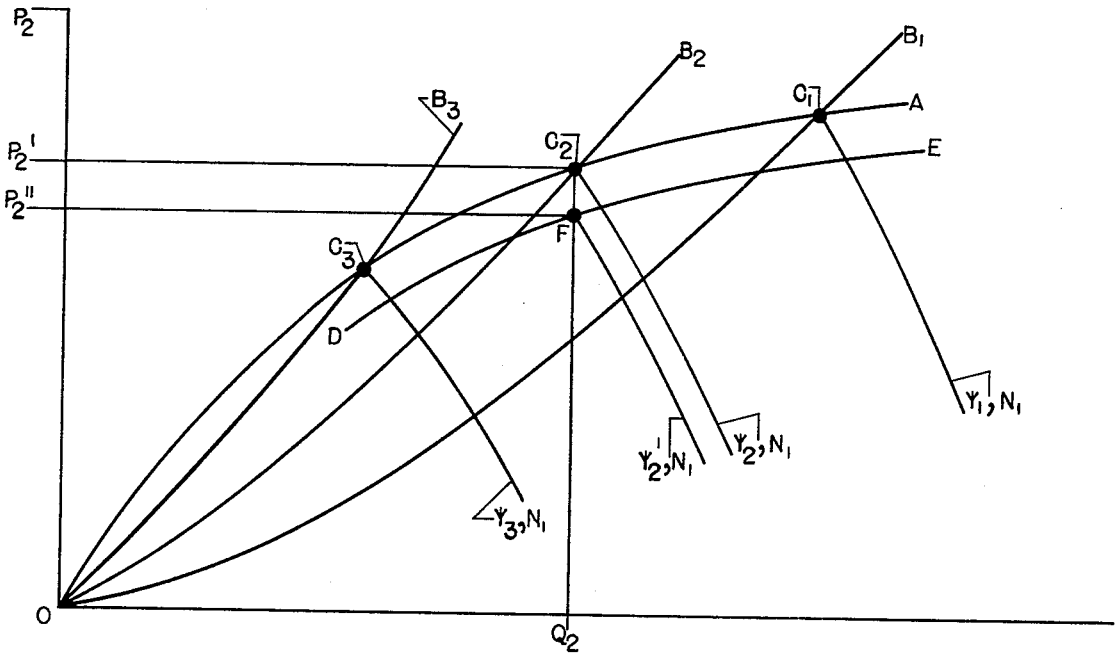
FIG. 2 is a compressor map.

Assume that the compressor map of an axial compressor 101 is shown on FIG. 2. Assume further for simplicity that this map corresponds to certain constant r.p.m. and ambient air conditions.

The pumping limit OA of the blower in such a case is the locus of intersections of the blower's performance characteristics corresponding to different vanes positions $\Psi_1$ to $\Psi_3$ with the related surge limit lines $OB_1$ to $OB_3$.

For example, when the vanes position is $\Psi_2$, then the corresponding surge limit line is $OB_2$, and point $C_2$ represents the limit of stability achievable with this particular position of vanes.

If the speed of rotation changes, all the curves shown on FIG. 2 change their position.

Thus, with axial compressors with rotating vanes we have not one but two independent controllable variables influencing the compressor's performance inside of its safe operating zone: (1) speed of rotation and (2) position of vanes.

The available area of said safe operating zone depends on the chosen control strategy.

The optimum strategy is one which provides the widest operating range physically achievable under any given suction pressure and temperature and, at the same time provides reliable protection from dangerous operating conditions.

The invention being disclosed is developed to implement this optimum strategy.

The equation of the surge limit line of a dynamic compressor is usually presented as the following:

$$\Delta P_c = K_1 Q^2 (P_1/T_1) \quad (1)$$

where:

$\Delta P_c = P_2 - P_1$ is a pressure differential across the compressor, $P_1$ and $P_2$ being suction and discharge pressure, $Q$ is volumetric flow rate through the compressor, $T_1$ is the temperature of the gas in suction, $K_1$ is a coefficient depending on compressor's geometry.

Another known equation of surge limit line is:

$$N/Q = K_2, \quad (2)$$

where:

N is speed of rotation, r.p.m., $K_2$ is a coefficient depending on compressor's geometry.

For the compressors having variable geometry, coefficients $K_1$ (equation 1) and $K_2$ (equation 2) are dependent on the position of rotating vanes so that $$K_1 = 1/f_1(\Psi) \quad (3)$$

$$K_2 = 1/f_2(\Psi) \quad (4)$$

where $\Psi$ is vanes angle.

Using equations (3) and (4), the equations (1) and (2) may be transformed to describe the pumping limit line of a compressor having rotating vanes:

$$\Delta P_c = \frac{Q^2}{f_1(\psi)} \frac{P_1}{T_1} \quad (5)$$

$$N = [Q/f_2(\Psi)] \quad (6)$$

The functions $f_1(\Psi)$ and $f_2(\Psi)$ are empiric functions which may be defined by using the results of testing of each particular compressor.

If FIG. 2 represents the compressor map of an axial compressor having rotating vanes, built to the actual test results, then both functions $f_1(\Psi)$ and $f_2(\Psi)$ may be easily obtained like following.

Equations (5) and (6) may be represented like:

$$f_1(\psi) = \frac{Q^2}{\Delta P_c} \frac{P_1}{T_1} \quad (7)$$

$$f_2(\Psi) = Q/N \quad (8)$$

Assuming that the values of $P_1$ and $T_1$, are known, the values of $f_1(\Psi)$ and $f_2(\Psi)$ may be calculated for each point of the pumping limit OA (FIG. 2). For instance, for the point $C_2$:

$$f_1(\psi) = \frac{Q^2}{\Delta P} \frac{P_1}{T_1} \quad (7)$$

$$f_2(\Psi) = Q/N \quad (8)$$

Assuming that the values of $P_1$ and $T_1$ are known, the values of $f_1(\Psi)$ and $f_2(\Psi)$ may be calculated for each point of the pumping limit OA (FIG. 2). For instance, for the point $C_2$:

$$f_1(\psi)\, c_2 = \frac{Q_2^2}{(\Delta P_c)_{c_2}} \frac{P_1}{T_1}$$

where $(\Delta P_c)_{C_2} = P_2 - P_1$;

$$f_2(\Psi)_{c_2} = Q_2/N_1,$$

and so on.

Figure 3:
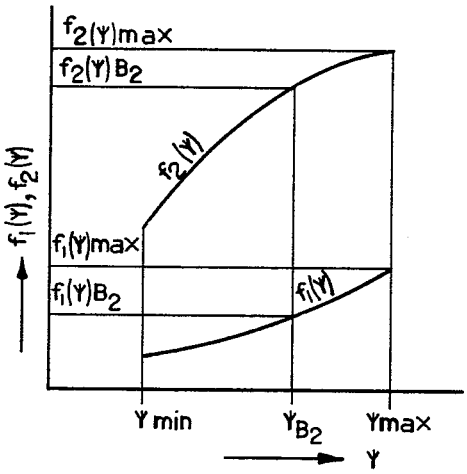
FIG. 3 represents the functions $f_1(\Psi)$ and $f_2(\Psi)$.

Since each calculated value of $f_1(\Psi_i)$ and $f_2(\Psi)$ corresponds to a definite vanes angle $\Psi_i$, in the above example to the angle $\Psi_2$, it is possible, finally, to represent both $f_1(\Psi)$ and $f_2(\Psi)$ graphically, as shown on FIG. 3. Note that both functions are proportional to $\Psi$.

The equation (8) actually represents a family of pumping limit lines, each of those lines corresponding to a definite speed of rotation. So the position of the pumping limit obviously depends on the chosen law of changing $f_2(\Psi)$.

Let us show that for each given suction temperature and pressure $T_1$ and $P_1$ the widest operating range achievable may be provided only if the following law is used:

$$f_2(\Psi) = K_3 Q, \quad (9)$$

where $$K_3 = 1/N_{max}, \quad (10)$$

and $N_{max}$ is a maximum permissible speed of rotation.

Figure 4:
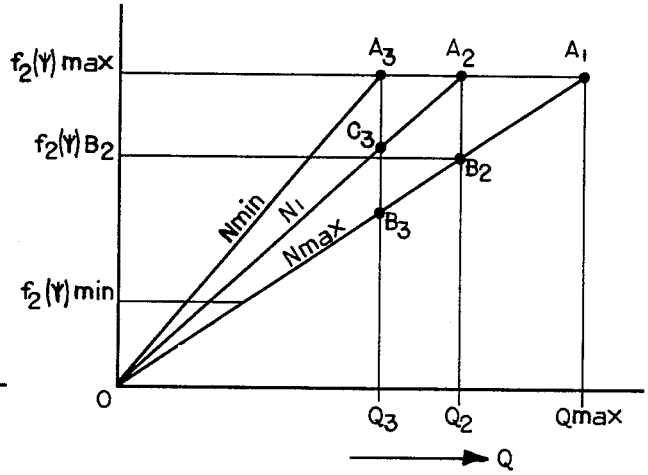
FIG. 4 represents graphically the equation of the family of pumping limit lines.

Equation (8) may be presented graphically as shown on FIG. 4. It is clear from FIG. 4 that the point $A_1$, and only this single point corresponds at the same time to $N_{max}$, to maximum value $f_2(\Psi)_{max}$ of the function $f_2(\Psi)$ and to maximum flow rate through the compressor $Q_{max}$.

For any flow rates less than $Q_{max}$, see FIG. 4, the values of $f_2(\Psi)$ achievable change within a section limited by the lines corresponding to $N_{max}$, $N_{min}$, $f_2(\Psi)_{max}$ and $f_2(\Psi)_{min.\ Here\ above\ Nmin}$ is a minimum speed of rotation permissible during the normal operation, $f_2(\Psi)_{max}$ corresponds to a maximum and $f_2(\Psi)_{min}$ to a minimum permissible angle of vanes.

Thus, point $B_2$, FIG. 4, for instance, corresponds to $N_{max}$ and to the least value of $f_2(\Psi)$ achievable with the flow rate $Q_2$, designated on FIG. 3 as $f_2(\Psi)_{B2}$.

The value $f_2(\Psi)_{B2}$ corresponds to the angle $\Psi_{B2}$ (see FIG. 3 ) which therefore is the least angle achievable with the above flow rate $Q_2$.

Consequently, $f_1(\Psi)_{B2}$, see FIG. 3, is the least value of the function $f_1(\Psi)$ achievable with the flow rate $Q_2$.

The equation (5) may be presented as $$\Delta P_c = k_4 \frac{Q^2}{f_1(\psi)}, \quad (11)$$

where $k_4$ is a coefficient depending on suction conditions.

As follows from equation (11), for each given values of $k_4$ and Q the highest value of $\Delta P_c$ corresponds to the least achievable value of $f_1(\Psi)$.

Figure 5:
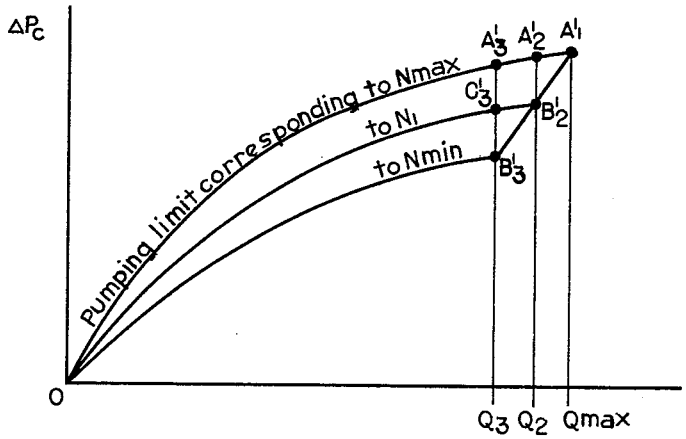
FIG. 5 represents a family of the pumping limits.

The family of curves representing the pumping limits corresponding to different values of N and built to equations (5) and (6) where $T_1$ and $P_1$ are some fixed values, is shown on FIG. 5. It is easy to make sure that points $A_1'$, $A_2'$, $A_3'$, $B_2'$, $B_3'$ and $C_3'$ on FIG. 5 correspond to the points $A_1$, $A_2$, $A_3$, $B_2$, $B_3$ and $C_3$ pm FIG. 4. Thus, it is proven that changing the function $f_2(\Psi)$ according to the equation (9) provides indeed for the widest operating range possible both pressure-wize and flow-wize. Equation (9) may be transformed to a following shape $$\Psi = f_3(Q) \quad (12)$$

Equation (12) represents the law of changing the vanes angle $\Psi$ providing for the widest operating range possible. It can be presented graphically or easily approximated by an analytic function.

Since each point of the optimum pumping limit (line $OA_1'$ on FIG. 5), as was shown above, corresponds to a maximum speed of rotation $N_{max}$, the strategy required for obtaining the widest operating range possible for a compressor having rotating vanes can be introduced by two simple equations:

$$\Psi = f_3(Q) \quad (13)$$

$$N \leqq N_{max}$$

The same equations (12) and (13) may be used for calculating the surge control line equidistant with the pumping limit, only with different constant coefficients in equation (12). This surge control line may be built, for example, to satisfy the equation:

$$\Delta P = P_i - P_i' \quad (14)$$

where $\Delta P$ is a desired safe pressure difference, $P_i$ is pressure corresponding to pumping limit, $P_i'$ is pressure corresponding to surge control line, both $P_i$ and $P_i'$ corresponding to the same value of flow rate $Q_i$.

For example, see FIG. 2, when $Q_i = Q_2$, then $P_i = P_2'$ and $P_i' = P_2''$, line DE being the surge control line.

If on FIG. 2 $N_1 = N_{max}$, then equation (12) must be modified so that each point of surge control line DE will now correspond to the maximum r.p.m. $N_{max}$, and, finally the two following equations are assumed as a basis for method and system for controlling the compressor with rotating vanes being disclosed:

$$\Psi = f_3'(Q) \quad (15)$$

$$N \leqq N_{max},$$

where equation (15) differs from equation (12) only by values of the constant coefficients.

In such a case the performance curve corresponding to point F of intersection of process control line $Q_2$ = Const and surge control line will be $\Psi_2'$, $N_1$ (see FIG. 2).

The control system shown in FIG. 1 is an integrated multi-module system. The measuring module 108 of this system provides for measuring (1) a pressure differential across the inlet flow measuring device, (2) inlet pressure and (3) temperature and (4) speed of rotation. Correspondingly, said measuring module includes four transmitters: a pressure differential transmitter 109, an inlet pressure transmitter 110, an inlet temperature transmitter 111 and a speed transmitter 112.

The output signals of above transmitters enter the calculating module 113 and a performance control module 114.

The above calculating module 113 provides for defining the actual magnitudes of mass and volumetric flow rates through the compressor 101. Said module 113 consists of a multiplier-divider 115 calculating an actual density of gas, a square root extractor 116 calculating an actual mass flow rate through the compressor 101 and a multiplier-divider 117 calculating a volumetric flow rate.

Said multiplier-divider 117 receives the signal proportional to the mass flow rate either from (1) the square root extractor 116 or (2) from the automanual station 130 of the flow controller 129. Both of the signals (from 116 or 130) enter the low signal limiter 123.

The performance control module 114 provides for changing the performance of the compressor according to a required law. The performance module 114 includes a speed controller 118 and a steam distributing system 119 with an actuator 120.

The performance control module 114 shown in FIG. 1 receives its set point from a protective control module 121 which includes a function generator 122, an actuator 124 of rotating stator vanes 102, a summer 125, a high signal limiter 126, a low signal limiter 127 and an actuator 107 of the blow-off valve 106.

The function generator 122 of the protective module 121, see FIG. 1, calculates the function $f_3'$ (Q), see equation (15). The output signal of said component 122 enters the actuator 124 of the rotating vanes, and so the vanes change their position always according to equation (15). The output signal of said component 122 enters also summer 125. Such a structure of the protective module 121 allows for compensation for the influence from the changing of the position of the vanes on the compressor's performance. This influence is compensated either during the transient processes caused by the load change or during both transient and steady-state processes caused by changing the set point for a flow controller 129.

Said summer 125 receives not only the output signal of the function generator 122 but also the output signal of the process control module 128, which consists of the two mode flow controller 129 and an auto-manual station 130. The output signal of the summer 125 of said protective control module 121 enters simultaneously two signal limiters. The first of them, the high signal limiter 126 is connected to the performance control module 114, as has already been mentioned. The second one, the low signal limiter 127, is connected to the actuator 107 of the blow-off valve 106.

The above high signal limiter 126 is tuned to limit the set point for the performance control module 114 by limiting the speed of rotation at a maximum permissible level $N_{max}$. This prevents the compressor from both rotating too fast and approaching the instable zone of operation.

On the other hand, said low signal limiter 127 is adjusted so that its output signal appears simultaneously with the saturation of the output signal of the high signal limiter 126. This means that the flow rate through the compressor 101 is being maintained on a constant level by blowing-off through valve 106 even after the set point for the performance control module 114 reaches its permissible maximum.

After the above mentioned saturation is reached, the performance control module 114 and the protective control module 121 operates simultaneously in such a way that under further load growth the operating point of the compressor during transient processes is moving only along the line limiting its safe operating zone.

Moreover, the suggested configuration of the protective module 121 allows, in effect, for stabilization of the compressor with a very small, if any, deviation at the point of intersection of the process control line (the line of the constant mass flow rate) and the line limiting the safe operating zone by proper adjustment of steady-state and dynamic parameters of the control system. The reason for this is that both the performance and protective control modules 114 and 121 respectively keep the operating point of the compressor on the line limiting the safe operating zone by simultaneously changing the position of rotating vanes and maintaining the constant maximum speed of rotation, then, at the same time, the flow controller 128 continues to maintain the flow rate through the installation by opening the blow-off valve 106.

This means that the flow controller 128, by not allowing the flow rate through the compressor to drop, helps the performance and protective control modules to protect the compressor from surge.

Therefore, the above described system, according to the definition mentioned above in the background of the invention is indeed a noninteracting control system.

Figure 6:
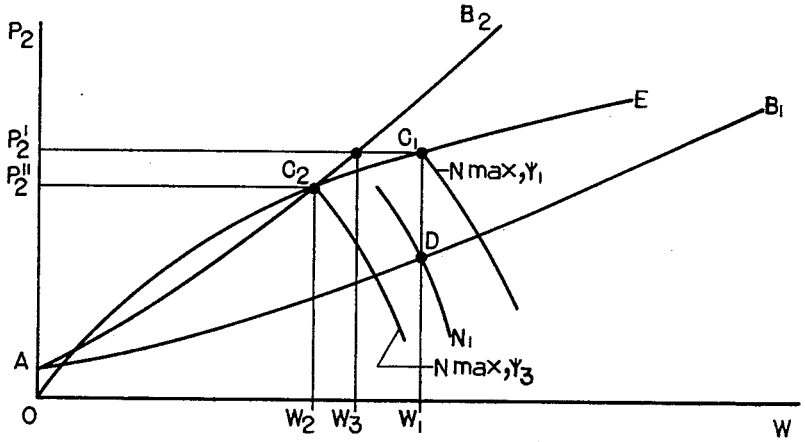
FIG. 6 is a compressor map.

The operation of the system shown in FIG. 1 can be illustrated by the following example (see FIG. 6). Assume that the required mass flow rate is $W_1$, the load curve is $AB_1$, the operating point is D, the speed of rotation is $N_1$, and surge control line is OE.

Under such conditions, the process control module 128 of the system shown in FIG. 1 maintains a constant mass flow rate through the compressor 101 by changing the set point of the performance control module 114. The module 114 provides for a required speed of rotation of the installation. As was mentioned above, the input signal for the actuator 124 of rotating vanes and the set point for the performance control module 114 stay, in effect, invariant with respect to changing the output signal of the function generator 122 of the protective module 121 until the output signal of the signal limiter 126 reaches its maximum possible magnitude. Let us further assume that, as a result of the load increase, the load curve moves to a new position $AB_2$ (FIG. 6). Under such circumstances the compressor immediately shows a tendency to decrease the flow rate through it.

Consequently, the process control module 128, trying to maintain the constant mass flow rate, begins to change the set point for the performance control module 114 in order to restore the mass flow to its required level. As a result, the speed of rotation is being increased, and operating point moves up along the flow control line $C_1D$.

According to above described design principles, under any suction conditions, the maximum possible magnitude of the output signal of the signal limiter 126 and, correspondingly, the beginning of opening the blow-off valve 106 are determined by adjustment of signal limiter 126 ($N \leqq N_{max}$). So for the mass flow rate $W_1$ the beginning of opening the blow-off valve 106 corresponds to the point $C_1$ on the compressor may (see FIG. 6).

When the compressor's operating line crosses in point $C_1$ the line OE limiting its safe operating zone, the output signal of the signal limiter 126 reaches its maximum possible magnitude and consequently, the output signal of the signal limiter 127 appears.

After that and under any further load increase, during the transient process, the protective control module 121 simultaneously keeps the set point for the performance control module 114 at the same level, closes the rotating vanes 102 and opens the blow-off valve 106. Opening of the blow-off valve 106 is provided simultaneously by the function generator 122 (only during transient process) and by flow controller 129.

As a result, the compressor's performance stays, in effect, unchanged, and its operating point is stabilized at the point $C_1$ of intersection of the compressor's operating line $C_1D$ with the line OE limiting the safe operating zone with a very small, if any deviation during the transient process.

Since the new position of the load line is $AB_2$, at the end of the transient process the user receives the amount $W_3$ of compressed air under the discharge pressure $P_2'$ (see FIG. 6), and the amount $\Delta W = W_1 - W_3$ is bleeding into the atmosphere.

Usually within the normal operating range the line OE (FIG. 6) limiting safe operating zone is relatively flat. This means that in some cases similar to the one described above, it may be worthwhile to conserve energy by eliminating such bleeding when the related discharge pressure decrease is tolerable.

This may be done by manually decreasing the set point for the flow controller 129 by auto-manual station 130 (FIG. 1).

When the set point for the controller 129 is decreased, this results in a decrease of flow, according to equation (15) causing a closing of the vanes 102, the speed of rotation being still kept on the constant maximum permissible level $N_{max}$.

As a result, the operating point moves down along the line OE from position $C_1$ to position $C_2$ (see FIG. 6). The compressor's performance curve correspondingly moves from position $N_{max}$, $\Psi_1$ to position $N_{max}$, $\Psi_3$, where $\Psi_3 < \Psi_1$.

The consequent discharge pressure decrease is $\Delta P = P_2' - P_2''$.

This possibility of saving a considerable amount of energy by sacrificing only a little in a discharge pressure level is an important advantage of the axial compressor with rotating vanes which may be fully utilized by using the above described method of control.

Obviously many modifications and variations of the present invention are possible in light of the above teachings. It is therefore to be understood that, within the scope of the appended claims, the invention may be practiced otherwise than as specifically described.

We claim:

1. A method of controlling a system including a dynamic compressor with rotating vanes having suction and discharge ports and a safe operating zone, a turbine driver, a pipeline connecting said discharge port to a user of a compressed gas, control members capable of moving a compressor's operating point along its required operating line by changing its performance, a fluid relief means connected to said pipeline, a flow measuring device installed in said suction port of the compressor, a pressure measuring device for measuring suction pressure, a temperature measuring means for measuring suction temperature, said method comprising:

calculating the mass flow rate and volumetric flow rate of a gas through the compressor;

changing the position of rotating vanes to maintain a constant optimum relationship between the vanes position and said volumetric flow rate through the compressor, said relationship being closen to provide for the maximum permissible level of speed of rotation along the line limiting the compressor's safe operating zone which corresponds to a widest safe operating range achievable without opening said fluid relief means;

controlling the required mass flow rate through the compressor by changing the speed of rotation until the compressor's operating point reaches said line limiting the safe operating zone; and simultaneous and noninteractingly controlling the mass flow rate through the compressor and protecting compressor from approaching its zone of instable operation by simultaneously changing an outflow through said fluid relief means, limiting said maximum permissible level of the speed of rotation and maintaining said optimum relationship between the position of rotating vanes and the volumetric flow rate through the compressor after its operating point reaches said line limiting its safe operating zone.

2. A control apparatus for controlling a system including a dynamic compressor with rotating vanes having suction and discharge ports and a safe operating zone, a turbine driver, a pipeline connecting said discharge port to a user of a compressed gas, control members capable of moving an operating point of the compressor along its operating line by changing its performance, a fluid relief means connected to said pipeline, a flow measuring device installed in said suction port of the compressor, a pressure differential transmitter measuring the pressure differential across said flow measuring device, transmitters measuring suction pressure and temperature, a speed transmitter, calculating means for defining an actual mass flow rate and a volumetric flow rate through the compressor, a process control means for maintaining a constant mass flow rate through the compressor, a performance control means for controlling the speed of rotation of the compressor, and a protective control means for keeping the operating point of the compressor inside of its safe operating zone, the improvement comprising:

a function generator means for controlling the position of the rotating vanes to maintain a constant optimum relationship between the vanes position and the volumetric flow rate through the compressor;

a summer means for summarizing an output signal of said process control means with a signal proportional to an output signal of said function generator means in order to compensate for an influence of the rotating vanes position change on the compressor's performance until the operating point of compressor reaches a line limiting its safe operating zone;

a high signal limiter means for receiving its input signal from said summer means and limiting the maximum permissible speed of rotation; and a low signal limiter means for controlling the outflow through said fluid relief means in response to a change of an output signal of the summer means, said output signal from the summer means being dependent on changes of both the volumetric flow rate through the compressor and an output signal of said process control means; said low signal limiter means being adjustable whereby under an increase of the output signal of said process control means, the summer means output signal appears simultaneously with a beginning of limitation of an output signal of said high signal limiter means; said low signal limiter means in conjunction with said summer means and said function generator means thereby providing for a noninteracting control of flow through the compressor and protection of the compressor from surge.

* * * * *